United States Patent [19]

Kawai

[11] Patent Number: 4,563,797

[45] Date of Patent: Jan. 14, 1986

[54] SAFETY BELT BUCKLE

[75] Inventor: Osamu Kawai, Fujisawa, Japan

[73] Assignee: NSK-Warner K. K., Tokyo, Japan

[21] Appl. No.: 667,849

[22] Filed: Nov. 2, 1984

[30] Foreign Application Priority Data

Nov. 9, 1983 [JP] Japan ..... 58-172361[U]

[51] Int. Cl.[4] ..... A44B 11/25

[52] U.S. Cl. ..... 24/641; 24/637; 24/644

[58] Field of Search ..... 24/641, 644, 637, 170, 24/191

[56] References Cited

U.S. PATENT DOCUMENTS

| | | | |
|---|---|---|---|
| 2,904,866 | 9/1959 | Carter | 24/170 |
| 3,355,781 | 12/1967 | Silberschlag | 24/230 |
| 3,514,821 | 6/1970 | Saxmark | 24/641 |
| 3,523,341 | 8/1970 | Spires | 24/641 |
| 3,562,877 | 2/1971 | Pringle et al. | 24/230 |
| 3,790,994 | 2/1974 | Jakob | 24/637 |
| 3,846,876 | 11/1974 | Weman | 24/641 |
| 3,871,090 | 3/1975 | Romanzi, Jr. et al. | 24/641 |
| 4,134,186 | 1/1979 | Krautz | 24/641 |
| 4,358,877 | 11/1982 | Burke | 24/641 |
| 4,394,792 | 7/1983 | Schmidt | 24/637 |

FOREIGN PATENT DOCUMENTS

| | | | |
|---|---|---|---|
| 2263955 | 7/1974 | Fed. Rep. of Germany | 24/641 |
| 79106 | 6/1981 | Japan . | |

*Primary Examiner*—Victor N. Sakran

*Attorney, Agent, or Firm*—Shapiro and Shapiro

[57] ABSTRACT

A safety belt buckle comprises a tang, a base having an engaging portion in the form of a cut-away in the wall portion thereof and meshing with the tang by the engaging portion, a lever member pivotably provided on the base and capable of assuming a latched position in which the tang is unseparably engaged with the engaging portion during the mesh engagement between the tang and the engaging portion and a non-latched position which permits the tang to be disengaged from the engaging portion, holding means for holding the lever member in the direction of the latched position when the lever member is in the latched position, operating means for releasing the holding of the lever member in the latched position by the holding means and bringing the lever member from the latched position to the non-latched position, and push-out means for sensing the movement of the lever member from the latched position to the non-latched position and pushing the tang out of the engaging portion.

9 Claims, 5 Drawing Figures

SAFETY BELT BUCKLE

BACKGROUND OF THE INVENTION

1. Field of the Invention

This invention relates to a so-called double latch type safety belt buckle provided with an engaging portion engageable with a tang and a latch member for preventing the tang from moving away from the engaging portion.

2. Description of the Prior Art

Various buckles of this type have heretofore been proposed, but many of them have a disadvantage in that they are complicated in structure because they require a latch member in addition to an engaging member having an engaging portion, both movably provided on a base, or in that the engaging portion is in the form of a protrusion and the mesh engagement between the engaging portion and a tang is unreliable or unstable, or in that the latch dissociating force is not moderate due to the manner in which the engaging portion and the latch member receive the force exerted on the tang, or in that it is not easy to add means which perform various functions and the buckle lacks flexibility of design.

SUMMARY OF THE INVENTION

It is therefore an object of the present invention to provide a safety belt buckle in which the engaging portion is formed as a cut-away in the base and the latch member is in the form of a lever member pivotably provided on the base, whereby the dissociating force is small and the mesh engagement between the tang and the engaging portion is reliable and which readily permits the change of the design for improving the operability etc. and which is excellent in flexibility of design and simple in structure.

The invention will become fully apparent from the following detailed description thereof taken in conjunction with the accompanying drawings.

DESCRIPTION OF THE PREFERRED EMBODIMENTS

Some embodiments of the present invention will hereinafter be described by reference to the drawings.

FIGS. 1 to 4 show a first embodiment of the present invention used as a buckle mounted on the inner side of an active belt or an emergency-openable buckle of an automatic belt.

Figure 1:
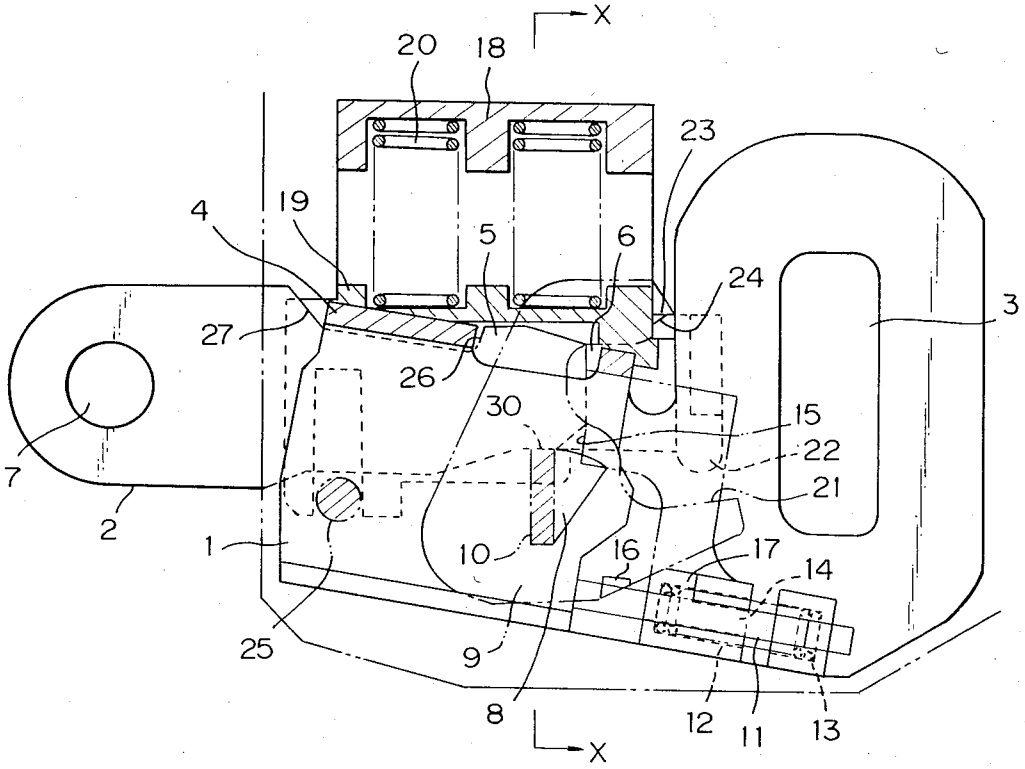
FIG. 1 is a partly broken-away plan view showing a first embodiment of the present invention with the cover removed.
Figure 2:
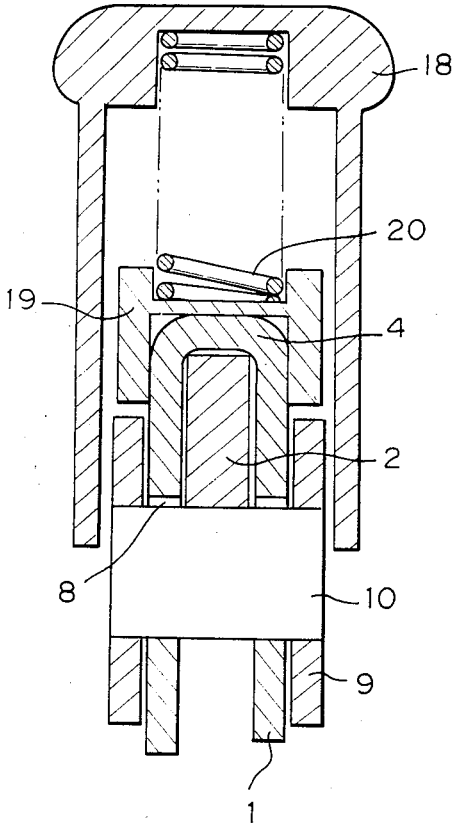
FIG. 2 is a cross-sectional view taken along line X—X of FIG. 1.

Referring to FIG. 1 and FIG. 2 which is a cross-sectional view taken along line X—X of FIG. 1, a base 1 has a portion having a U-shaped cross-section forming an insertion space for a tang 2 and a portion formed with a slot 3 for mounting a belt, not shown. A wall 4 which is a bent portion of the U-shaped portion is formed with a cut-away portion 6 for meshing with a protrusion 5 which is a first engaging portion of the tang 2. The tang 2 is further formed with a circular hole

7 into which a tightening member is inserted to be mounted on the vehicle body side.

A latch 10 which is a lever member fitted to a side plate 9 and pivotable therewith into engagement with a second engaging surface 30 of the tang 2 is disposed in a pair of sector holes 8 formed in opposed relationship with each other in the U-shaped portion of the base 1. The side plate 9 extends so as to embrace the U-shaped portion of the base 1 and is of a two-layer structure.

A slider 12 is guided along a guide groove 11 formed in the base 1, the slider 12 being biased so as to push out the tang 2 (leftwardly as viewed in FIG. 1) by a push-out spring 14 extended between a spring holder 13 secured to the base 1 and the slider 12. The slider 12 has a portion formed with a surface 15 adapted to bear against the fore end surface of the tang 2, and a portion having a projection 17 for engaging a projection 16 formed in the lower portion of the side plate 9 as viewed in FIG. 1.

Above the base 1 as viewed in FIG. 1, a push button 18 is vertically movably provided while embracing the base 1 and the side plate 9 from the opposite sides thereof. The push button 18 is biased upwardly as viewed in FIG. 1 by a pair of coil springs 20 extended between a spring holder 19 secured to the side wall 4 of the base 1 and the push button 18. The push button 18 is formed with a protrusion 22 for striking against the upwardly facing surface 21 of the right portion of the side plate 9 to turn the side plate 9 and the latch 10 clockwise when the button 18 is moved downwardly, and a corner portion 24 adapted to bear against the corner portion 23 of the upper portion of the side plate 9. The biasing force of coil springs 20 as a biasing member is transmitted to the latch 10 through the contact between the upwardly facing surface of the corner portion 24 of the button 18 and the downwardly facing surface of the corner portion 23 of the side plate 9 to thereby bias the latch 10 counter-clockwise.

Further, a pin 25 is studded in the base 1 so that the tang 2 meshing with the cut-away portion 6 of the base 1 and restrained by the latch 10 may not be pulled outwardly. Also, the left rising surface 26 of the protrusion 5 of the tang 2 as viewed in FIG. 1 is formed so as to rise at an angle so that when the tang 2 is pulled outwardly, the protrusion 5 slips out of the cut-away portion 6 of the base 1 and a downward force is applied to the tang 2.

Operation of the first embodiment will now be described on the basis of the above-described construction.

FIG. 1 shows a state in which the tang 2 is latched to the base 1. In this latched state, the protrusion 5 is engaged with the cut-away portion 6 and the downward movement of the tang 2 as viewed in FIG. 1 is limited by the latch 10 which is in a position substantially opposed to the cut-away portion 6 and forming substantially a right angle or an obtuse angle with the direction in which the tang is inserted. Likewise, in this latched state, even if a downward prizing force is applied to the tang 2, such force is received by the pin 25 and the latched state is not released and, even if a clockwise force is applied to the latch 10 by a shock or the like, the side plate 9 and the latch 10 are prevented from being turned clockwise by the contact between the rightwardly facing surface of the corner portion 23 of the side plate 9 and the leftwardly facing surface of the corner portion 24 of the push button 18.

Thus, in the latched state, the coupling between the tang 2 and the base 1 is reliably accomplished.

Figure 3:
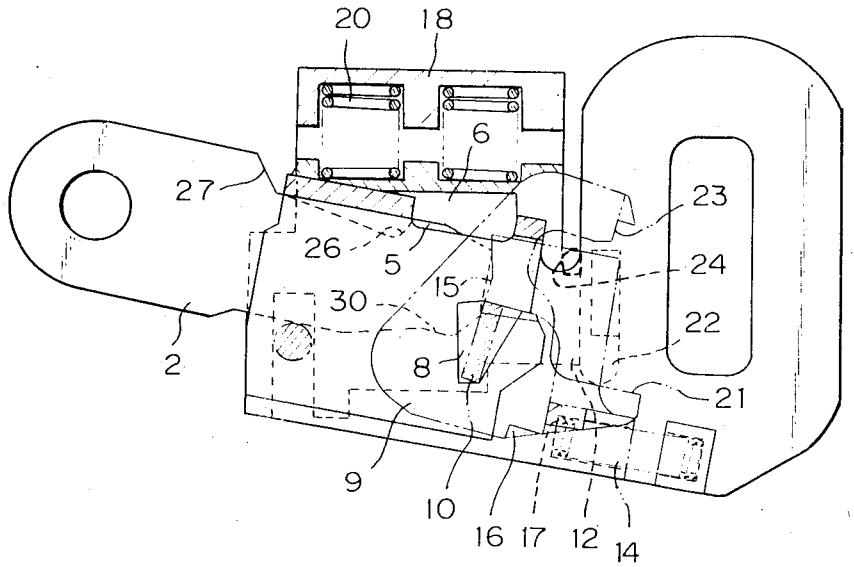
FIGS. 3 and 4 illustrate the operation of the first embodiment.

In the state of FIG. 1, when the push button 18 is depressed against the biasing force of the coil springs 20, the mesh engagement between the corner portion 23 of the side plate 9 and the corner portion 24 of the push button 18 is first released and the side plate 9 and the latch 10 become turnable clockwise. When the push button 18 is further depressed, the protrusion 22 of the button 18 bears against the surface 21 of the side plate 9 as shown in FIG. 3 and the side plate 9 and the latch 10 begin to be turned clockwise. When the latch 10 is turned clockwise in the sector hole 8 and comes out of engagement with the tang 2, the tang 2 moves downwardly as shown in FIG. 3 because the protrusion 5 of the tang 2 is free to slip out of the cut-away portion 6, and the tang 2 is further pushed out by the push-out spring 14 through the slider 12.

When the tang 2 is pushed out, the portion of the slider 12 in which the contact surface 15 is formed slides upwardly of the latch 10 and at the same time, the projection 17 of the slider 12 slides upwardly of the the projection 16 of the side plate 9. At this time, the push button 18 is still depressed and therefore, the side plate 9 remains turned clockwise. When the push button 18 is now released, it is moved upwardly by the force of the coil springs 20 and the corner portion 24 strikes against the side plate 9 and thereby turns it somewhat counter-clockwise. However, when the projection 16 of the side plate 9 comes to bear against the projection 17 of the slider 12, the counter-clockwise turning of the side plate 9 and latch 10 is stopped and further, the upward movement of the push button 18 is also stopped. Thus, the stand-by position of FIG. 4 is maintained until the tang 2 is then inserted.

Figure 4:
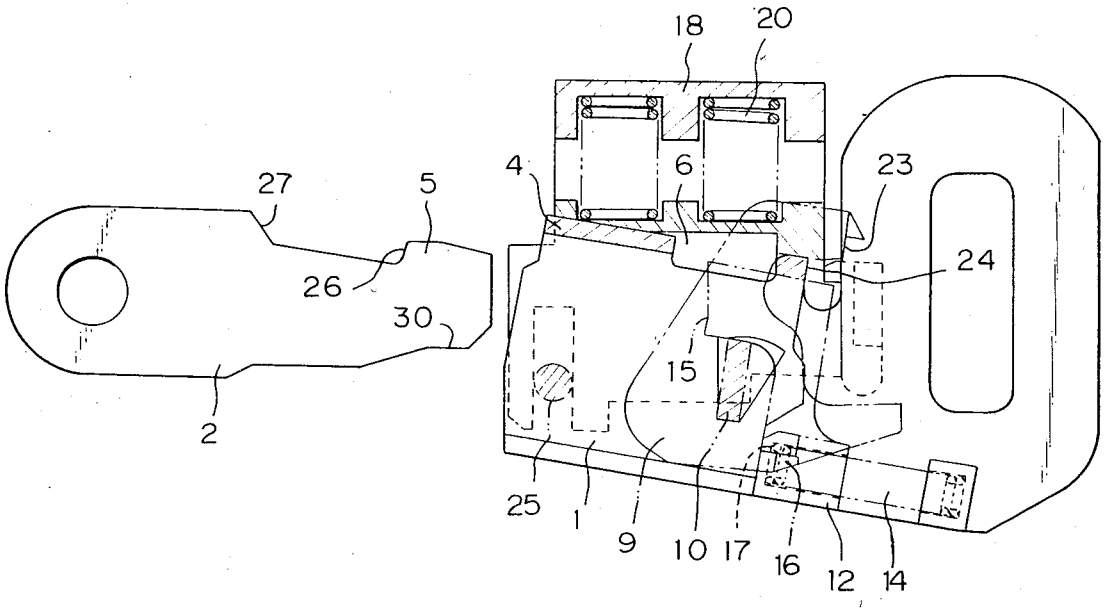

In the stand-by position of FIG. 4, the tang 2 is inserted between the side wall 4 of the base 1 and the pin 25 and when the fore end of the tang 2 strikes against the latch 10 while pushing back the slider 12 rightwardly, the latch 10 and the side plate 9 are turned clockwise while the button 18 is depressed downwardly against the force of the coil springs 20. That is, at this time, the side plate 9 is turnable clockwise because the corner portion 23 of the side plate 9 is not engaged with the corner portion 24 of the button 18.

When the tang 2 is inserted until the protrusion 5 of the tang 2 becomes engageable with the cut-away portion 6 of the base 1, the fore end of the tang 2 is pushed upwardly by the spring force of the coil springs 20 applied to the latch 10 through the button 18 and the side plate 9 and the protrusion 5 comes into engagement with the cut-away portion 6. Further, the projection 17 of the slider 12 is out of engagement with the projection 16 of the side plate 9 and therefore, the latch 10 is turned counter-clockwise to the position of FIG. 1 and comes into engagement with the engaging surface opposite to the protrusion of the tang 2, thus bringing about the state of FIG. 1.

During the insertion of the tang, an inclined surface 27 formed on the tang 2 strikes against the left end surface of the side wall 4 of the base 1 and the tang 2 relatively rocks upwardly about this portion, whereby the protrusion 5 of the tang 2 semi-naturally fits into the cut-away portion 6 of the base 1.

Figure 5:
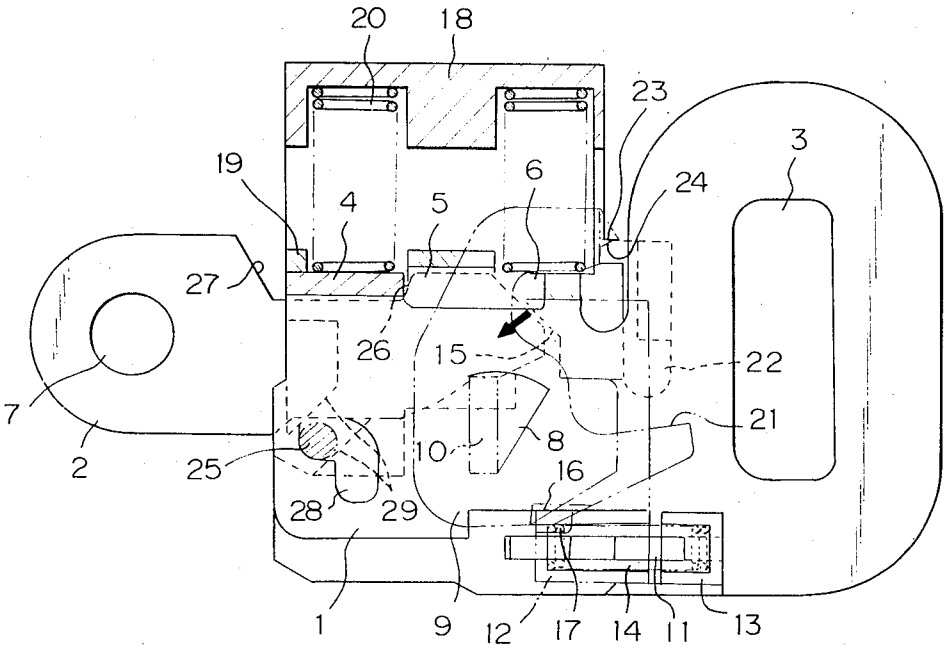
FIG. 5 is a view similar to FIG. 1 but showing a second embodiment of the present invention.

FIG. 5 shows a second embodiment in which the pin 25 is designed to move downwardly in a bent groove 28 provided in the base 1 with the downward movement of the push button 18 in order to improve the feeling of the insertion and dissociation of the tang.

That is, the pin 25 moves up and down due to the action of opposed cam surfaces 29 formed in the button 18, in accordance with the upward and downward movement of the button 18. Also, if the surface of contact between the slider 12 and the tang 2 is angled so as to ensure the tang 2 to be biased in the direction of dissociation as indicated by the arrow, the freedom of slip-out will become more reliable.

In the other points, the second embodiment is substantially the same as the first embodiment with the only exception that the second embodiment somewhat differs in shape from the first embodiment and therefore, the second embodiment need not be described any further.

In each of the above-described embodiments, a downwardly extending projection may be formed on the push button 18, whereby the tang 2 may be pushed downwardly after the dissociation of the latch 10 to positively push the protrusion 5 out of the cut-away portion 6.

According to the present invention, as described above, the engaging portion engageable with the tang is provided as a cut-away portion in the base and therefore, mesh engagement between the tang and the engaging portion can be ensured easily and the structure is simple, and the tensile force applied to the tang is received by the base and only the slippage of the tang is suppressed by the latch member and moreover, the latch member is in the form of a pivotally movable lever member and therefore, it is easy to reduce the dissociation force by the setting or the like of the lever ratio and further, the structure is simple and excellent in flexibility of design.

I claim:

1. A safety belt buckle comprising a tang having a protrusion thereon at one side thereof, a base into which said tang is inserted, said base having a cut-away in a wall portion thereof that receives said protrusion of said tang, a lever member pivotally mounted on the base, said lever member being capable of assuming a latched position at which said lever member is oriented substantially perpendicular to the insertion direction of said tang into said base and engages a side of said tang opposite to the first-mentioned side to prevent movement of said protrusion out of said cut-away in a direction substantially perpendicular to the tang insertion direction, and a non-latched position in which said lever member is oriented in a direction different from its orientation in the latched position so as to permit movement of the protrusion out of said cut-away in a direction substantially perpendicular to the direction of tang insertion, holding means for holding said lever member in said latched position, operating means for moving said holding means to release said lever member from said latched position and for moving said lever member from said latched position to said non-latched position, and push-out means responsive to the movement of said lever member from said latched position to said non-latched position for pushing said protrusion of said tang out of said cut-away.

2. A safety belt buckle according to claim 1, wherein said base has pin means positioned to engage said opposite side of said tang when said protrusion is in said cut-away for preventing rocking movement of said tang in a direction that would tend to move said protrusion out of said cut-away.

3. A safety belt buckle according to claim 1, wherein said push-out means comprises means for pressing said tang in a draw-out direction from said base, and wherein said tang and said base have cooperable cam means for facilitating movement of said protrusion into and out of said cut-away.

4. A safety belt buckle comprising:

a flat tang having a protrusion at one side thereof in the same plane as the tang;

a base having a pair of parallel wall portions between which said flat tang is inserted, with the plane of the tang parallel to said wall portions, and having a further wall portion connecting said pair of wall portions, said further wall portion having a cut-away for receiving said protrusion of said tang to prevent the draw-out of said tang from said base;

a holding member disposed on said base and pivotable between a first position in which an engaging portion of said holding member is oriented substantially perpendicular to the insertion direction of said tang is said base and engages said tang at the side thereof opposite to the first-mentioned side to prevent said protrusion from moving out of said cut-away in a direction substantially perpendicular to the tang insertion direction, and a second position in which said engaging portion of said holding member is oriented in a direction different from its orientation at said first position so as to permit said protrusion to move out of said cut-away in a direction substantially perpendicular to the tang insertion direction; and control means for controlling the pivotal movement of said holding member between said first position and said second position.

5. A safety belt buckle according to claim 4, wherein said base has pin means positioned to engage said opposite side of said tang when said protrusion is in said cut-away for preventing rocking movement of said tang in a direction that would tend to move said protrusion out of said cut-away.

6. A safety belt buckle according to claim 4, wherein said control means is an operating device which is movable between a pushed-out position responsive to a biasing force of a biasing member and a pushed-in position responsive to an external force against the biasing force of the biasing member, said operating device having means of retaining said holding member in its first position when the operating device is in its pushed-out position and having means for moving said holding member to its second position when the operating device is moved to its pushed-in position.

7. A safety belt buckle according to claim 6, wherein said holding member comprises a rectangular plate disposed in sector holes provided in said pair of wall portions of said base and comprises side plates fixed to opposite ends of said rectangular plate, said holding member having a first surface that engages said means for retaining said holding member in said first position and having a second surface that engages said means for moving said holding member to said second position.

8. A saftey belt buckle according to claim 6, further comprising biasing means for moving said tang in a draw-out direction from said base when said holding member is moved to said second portion, and means for preventing said holding member from returning to said first position after said tang has been drawn out and until said tang is re-inserted in said base.

9. A safety belt buckle according to claim 8, wherein said tang has means for de-activating said preventing means as said tang is inserted in said base to permit said holding member to return to said first position when said protrusion is aligned with said cut-away, said holding member having biasing means for returning said holding member to said first position.

* * * * *